United States Patent [19]

LaBate

[11] Patent Number: 4,483,520

[45] **Date of Patent: * Nov. 20, 1984**

[54] DEVICE FOR INTRODUCING GAS INTO MOLTEN METAL

[76] Inventor: Michael D. LaBate, 115 Hazen Ave., Ellwood City, Pa. 16117

[ * ] Notice: The portion of the term of this patent subsequent to Aug. 2, 2000 has been disclaimed.

[21] Appl. No.: 531,851

[22] Filed: Sep. 14, 1983

[51] Int. Cl.[3] ..... C21C 5/48

[52] U.S. Cl. ..... 266/220; 266/265; 266/266; 266/270; 75/59

[58] Field of Search ..... 266/217, 220, 265, 266, 266/268, 270; 75/59, 60; 110/182.5

[56] References Cited

U.S. PATENT DOCUMENTS

| | | | |
|---|---|---|---|
| 1,729,447 | 9/1929 | McKee | 110/182.5 |
| 3,608,880 | 9/1971 | Gombert et al. | 266/268 |
| 3,834,685 | 9/1974 | Ziemkiewicz et al. | 266/220 |
| 4,396,179 | 8/1983 | LaBate | 266/220 |

*Primary Examiner*—L. Dewayne Rutledge
*Assistant Examiner*—Robert L. McDowell
*Attorney, Agent, or Firm*—Harpman & Harpman

[57] ABSTRACT

An apparatus is disclosed for incorporation in the normal refractory brick lining of a molten metal ladle through which apparatus gas can be introduced for stirring the molten metal. The device comprises a stirring block having a frustro-conical cavity therein and external configuration accommodating portions of the refractory lining of the ladle. A solid non-permeable refractory plug or the like of a frustro-conical shape is provided with a metal jacket spaced with respect to the exterior thereof to form an appropriate gas passageway and a spirally arranged continuous rib is formed on the exterior of the metal jacket for registry when rotated with a similarly shaped groove in the frustro-conical cavity in the stirring block. The engagement of the spirally arranged continuous rib and its registry with the correspondingly shaped continuous spiral groove in the cavity of the stirring block prevents the travel of molten metal thereby regardless of the degree of wear of the stirring block, the plug and the metal jacket thereof while the configurations on the exterior of the stirring block prevent the loosening or cracking of the block with respect to the refractory lining of the ladle and the escape of molten metal thereby as otherwise frequently occurs.

8 Claims, 3 Drawing Figures

DEVICE FOR INTRODUCING GAS INTO MOLTEN METAL

BACKGROUND OF THE INVENTION

1. Technical Field:

This invention relates to devices for insufflating gas into a mass of molten metal and apparatus associated therewith insuring against the escape of molten metal around the device or through parts thereof.

2. Description of the Prior Art:

Prior structures of this type have generally employed permeable plugs through which the gas is introduced into the molten metal. Such typical devices may be seen in U.S. Pat. Nos. 2,811,346, 2,947,527, 3,330,645, 3,334,829, 3,610,602 and my U.S. Pat. No. 4,396,179.

None of the devices of the prior art provide for the positive placement and retention of the apparatus in the refractory lining of the ladle or other molten metal vessel that will insure against the escape of molten metal around or through the apparatus.

The present invention avoids the problems that have been commonly associated with the prior art devices and in particular the failure of the respective portions of the apparatus to maintain a seal with respect to the molten metal and its escape from the ladle or vessel around and/or through the gas insufflating apparatus.

SUMMARY OF THE INVENTION

A device for introducing gas into molten metal in a ladle or other vessel through an opening therein utilizes a stirring block of a novel configuration incorporated in the refractory lining of the ladle or other vessel and having a passageway therethrough through which gas may be introduced into the molten metal for stirring purposes. An appropriately shaped plug having a metal or ceramic jacket thereabout and spaced with respect thereto to form a gas conduit is positioned in the passageway in the stirring block so that it cannot move with respect thereto and so that it will form a continuous seal with respect to the stirring block to prevent the escape of molten metal thereby despite the degree of wear and/or erosion of the stirring block and the plug and metal jacket of the device.

DESCRIPTION OF THE PREFERRED EMBODIMENT

Figure 1:
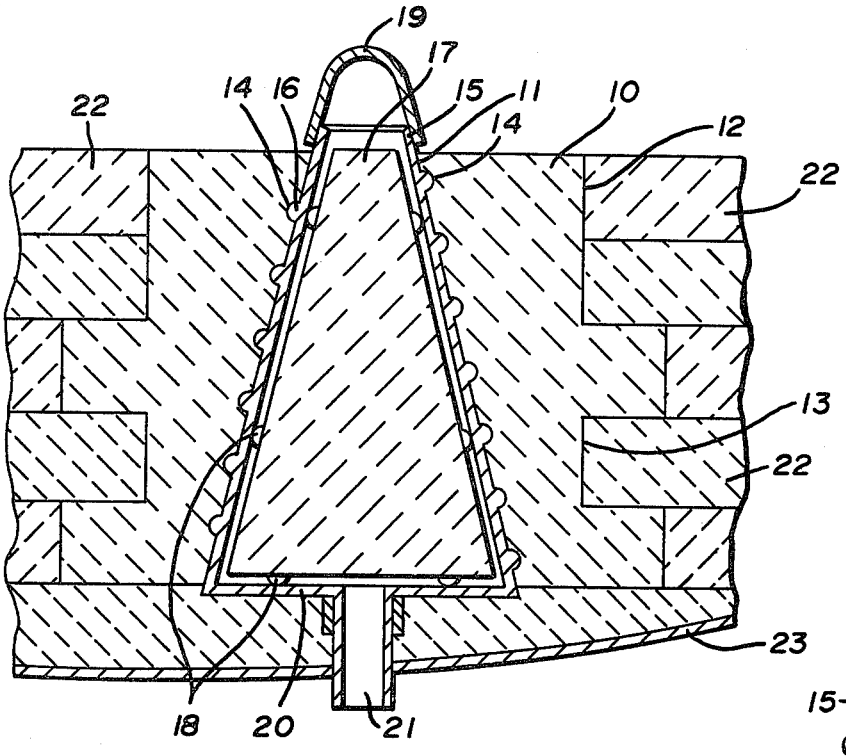
FIG. 1 is a cross sectional side elevation of the improved stirring block positioned in the refractory lining of a ladle with a plug having a spaced metal jacket positioned in a frustro-conical passageway in the stirring block.

In the form of the invention chosen for illustration herein, the device for introducing gas into molten metal and capable of retaining its desired position in the vessel containing the molten metal and sealing the several surfaces defined thereby with respect to the molten metal in the vessel comprises a stirring block 10 having a frustro-conical passageway 11 centrally thereof and one or more areas of reduced size 12 and 13 on its exterior.

A continuous spiral groove 14 is formed in the wall defining the inner surface of the frustro-conical passageway 11 of the stirring block 10 and a metal or ceramic shell 15 of frustro-conical shape matching the frustro-conical passageway 11 of the stirring block is positioned therein and provided with a continuous spiral rib 16 thereon arranged for continuous registry with the continuous spiral groove 14 heretofore referred to.

A frustro-conical non-permeable plug 17 is positioned within the shell 15 and maintained in closely spaced relation thereto by several spacing members 18. As illustrated in FIG. 1 of the drawings, the metal shell 15 is provided with a cap 19 as disclosed in my aforesaid U.S. Pat. No. 4,396,179 and which cap 19 is replaced as the device for introducing gas into molten metal wears away as by erosion of the molten metal in the vessel in which the device is installed. At such times a flat disc-like cap as disclosed in my aforesaid U.S. Pat. No. 4,396,179 is positioned over the exposed remaining portion of the passageway in the stirring block and the plug and shell.

The bottom of the frustro-conical metal or ceramic shell 15 is provided with a horizontal portion 20 which is apertured for the reception of a gas supplying conduit 21. The exterior of the stirring block 10 and the shoulder or groove-like configurations 12 and 13 thereof are adapted to be engaged by the refractory brick or rammed refractory 22 of the lining of the ladle or similar vessel as indicated by the numeral 23 in FIG. 1 of the drawings.

Figure 2:
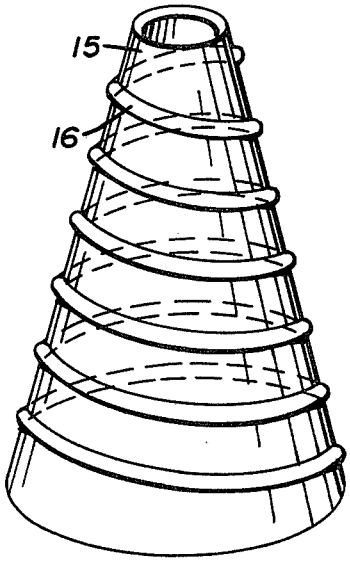
FIG. 2 is a perspective view of the plug and metal jacket portion of the device seen in FIG. 1 of the drawings.

By referring now to FIG. 2 of the drawings, it will be seen the the frustro-conical metal or ceramic shell 15 is provided with the continuous spiral rib on its outermost surface and extending from a point adjacent its lowermost portion to a point adjacent its uppermost portion. The continuous spiral rib 16 is of the same arrangement, spiral inclination and spacing as the continuous spiral groove 14 formed in the wall of the frustro-conical passageway 11 in the stirring block 10. When the device of the invention is assembled, the plug 17 is positioned within the shell 15, the bottom portion of the shell attached and the gas supplying conduit secured in registry with the opening therein. The device is then moved into the frustro-conical passageway 11 in the stirring block until the spiral continuous rib 16 is adjacent the spiral continuous groove 14 whereupon the plug 17 and its shell 15 are revolved to secure complete registry between the rib 16 and the groove 14 and thus effect a continuous spiral seal between the shell 15 and the stirring block 10. When the shell 15 is metal, it is sufficiently resilient to enable the continuous spiral rib 16 thereof to be snapped into the continuous spiral groove 14 when it is positioned adjacent thereto. This arrangement of interlocking parts insures against the accidental flow of molten metal through the passageway 11 and around the exterior of the plug 17 and its shell 15 as frequently occurs in the prior art devices.

The groove and shoulder configurations 12 and 13 formed in the exterior of the stirring block 10 enable the refractory bricks or rammed refractory lining of the ladle to register with the same sufficiently to prevent the stirring block 10 from moving out of its desired location and also to prevent the cracking of the seal between the refractory lining 22 and the exterior of the stirring block 10 which commonly occurs and permits the escape of molten metal from the ladle or other vessel.

Figure 3:
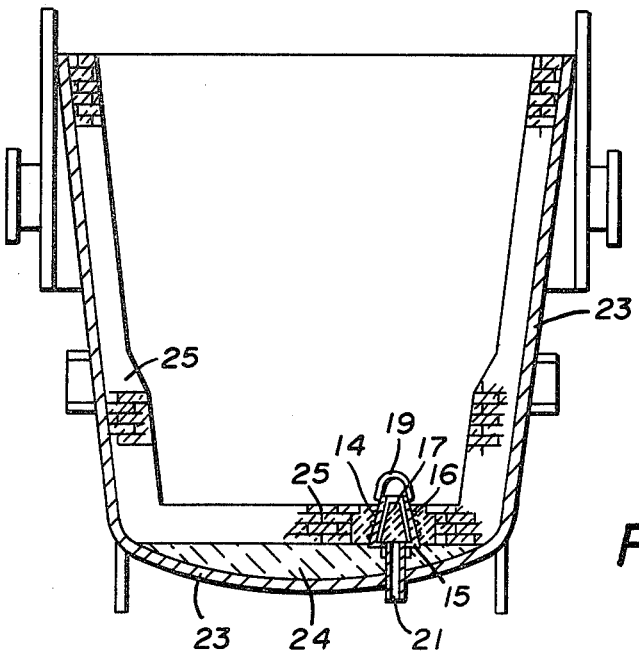
FIG. 3 is a cross sectional side elevation of a ladle showing the device for introducing gas into molten metal installed in the refractory lining of the ladle.

In FIG. 3 of the drawings, a cross sectional side elevation, on a reduced scale, of a ladle 23 may be seen with the bottom of the ladle comprising a rammed refractory area 24 and carrying the usual refractory brick inner lining 25 which extends up the sides of the ladle 23. The device of the invention is shown illustrated in the bottom of the ladle 23 and those skilled in the art will observe that suitable gas, such as nitrogen, will be supplied to the conduit 21 by a suitable tubular means and a supply source not shown.

The disclosed invention therefore accomplishes the dual purpose of insuring a non-clogging, continuously operating gas insufflating action with respect to the molten metal in the ladle or similar vessel and insuring against the accidental leakage of molten metal through and/or around the gas insufflating device.

Those skilled in the art will observe that as the usual wear, and/or erosion of the insufflating apparatus occurs, the configuration of the stirring block will maintain its desired location and seal with respect to the refractory lining and prevent the flow of molten metal thereby and that the wearing away or erosion of the stirring block, the plug and the shell thereabout will not affect the continuous seal provided by the continuous spiral rib 16 and its continuous engagement with the continuous spiral groove 14 and the ability of the resulting seal to prevent the flow of molten metal thereby.

It will also occur to those skilled in the art that while the preferred form of the invention incorporates the frustro-conical passageway 11 in the stirring block and the frustro-conical shell 15 and the frustro-conical plug 17, other configurations of the passageway through the stirring block and the shape of the plug and the shell thereabout may be used so long as they are cross sectionally round and the spiral continuous rib on the shell or alternately on the interior of the stirring block registers with the spiral continuous groove in the stirring block or alternately in the shell and the resulting changes in shape will not affect the sealing capabilities of the construction disclosed or modified.

While the present invention has been described with a degree of particularity, it should be appreciated that modificiations and alterations other than those disclosed may be made without departing from the spirit or scope of the invention as set forth in the appended claims.

What I claim is:

1. In a device for introducing gas into a mass of molten metal, the improvement which comprises a plug and a shell positioned thereabout in spaced relation thereto so as to form a gas conduit, a stirring block having a passageway extending therethrough, said stirring block adapted to form a portion of a refractory lining in a vessel containing a mass of molten metal, said vessel having an opening therein in communication with said passageway in said stirring block, said plug and the shell positioned thereabout being of a size engagable in said passageway in said stirring block, a continuously extending, spirally arranged rib on the exterior of said shell and a matching continuously extending spirally arranged groove in the wall of the stirring block defining the passageway, said continuous spirally arranged extending rib being registrable in said continuously extending spirally arranged groove so as to form a continuous seal between said shell and said stirring block when said shell and plug are rotated sufficiently to engage said rib in said groove.

2. The improvement in a device for introducing gas into a mass of molten metal set forth in claim 1 and wherein a plurality of projections are formed on the outer surface of said plug and arranged to position said shell in said spaced relation thereto.

3. The improvement in a device for introducing gas into a mass of molten metal set forth in claim 1 and wherein the plug is a body of solid refractory material and the shell positioned thereabout is metal.

4. The improvement in a device for introducing gas into a mass of molten metal set forth in claim 1 and wherein said and said shell are frustro-conical and said passageway extending through said stirring block is frustro-conical.

5. The improvement in a device for introducing gas into a mass of molten metal set forth in claim 1 and wherein said shell is frustro-conical and said passageway extending through said stirring block is frustro-conical and said shell is of an exterior size whereby the continuously extending spirally arranged rib on the exterior thereof matches the interior size of the frustro-conical passageway when the spirally arranged rib is in registry with the spirally arranged groove.

6. The improvement in a device for introducing gas into a mass of molten metal as set forth in claim 1 and wherein a plurality of covers for said stirring block and shell are arranged to be positioned in covering relation to said block and said shell before each filling of said vessel with said mass of molten metal.

7. The improvement in a device for introducing gas into a mass of molten metal set forth in claim 1 wherein said rib and said groove are in snap-fitting relationship with each other when said shell is positioned about said plug, with said shell being formed of metal which is sufficiently resilient to enable said rib to be snapped into said groove when it is positioned adjacent thereto.

8. In a device for introducing gas into a mass of molten metal, the improvement which comprises a plug and a shell positioned thereabout in spaced relation thereto so as to form a gas conduit, a stirring block having a passageway extending therethrough, said stirring block adapted to form a portion of a refractory lining in a vessel containing a mass of molten metal, said vessel having an opening therein in communication with said passageway in said stirring block, said plug and the shell positioned thereabout being of a size engagable in said passageway in said stirring block, a continuously extending, spirally arranged groove in the exterior of said shell and a matching continuously extending spirally arranged rib on the wall of the stirring block defining the passageway, said continuous spirally arranged extending rib being registrable in said continuously extending spirally arranged groove so as to form a continuous seal between said shell and said stirring block when said shell and plug are rotated sufficiently to engage said rib in said groove.

* * * * *